US007216462B2

(12) United States Patent
LeJeune et al.

(10) Patent No.: US 7,216,462 B2
(45) Date of Patent: May 15, 2007

(54) INSULATED CONCRETE PANEL BILLETS

(75) Inventors: Michael LeJeune, Wayzata, MN (US); Jason Hensley, Shakopee, MN (US); Thomas Kuckhahn, Prior Lake, MN (US); Donald Hall, New Prague, MN (US); Richard Wesen, Chisago City, MN (US); George Miks, Shakopee, MN (US)

(73) Assignee: Fabcon, Inc., Savage, MN (US)

( * ) Notice: Subject to any disclaimer, the term of this patent is extended or adjusted under 35 U.S.C. 154(b) by 429 days.

(21) Appl. No.: 10/973,098

(22) Filed: Oct. 26, 2004

(65) Prior Publication Data

US 2006/0101779 A1 May 18, 2006

(51) Int. Cl.
*E04C 5/08* (2006.01)

(52) U.S. Cl. ..... 52/223.6; 52/593.1; 52/309.4; 52/220.3; 52/742.14

(58) Field of Classification Search ..... 52/223.1, 52/223.6, 223.7, 223.8, 309.7, 309.8, 309.9, 52/309.11, 309.12, 309.14, 309.16, 309.17, 52/677, 682, 684, 687

See application file for complete search history.

(56) References Cited

U.S. PATENT DOCUMENTS

| | | | | | |
|---|---|---|---|---|---|
| 1,729,612 | A * | 10/1929 | Goldsmith | ..... | 52/320 |
| 2,033,751 | A * | 3/1936 | Yeager | ..... | 52/325 |
| 3,217,375 | A | 11/1965 | Kinnard et al. | | |
| 3,382,637 | A * | 5/1968 | Longinotti | ..... | 52/320 |
| 3,523,343 | A | 8/1970 | Mitchell et al. | | |
| 3,849,957 | A * | 11/1974 | Bastgen | ..... | 52/327 |
| 4,004,874 | A | 1/1977 | Foster | | |
| 4,133,859 | A * | 1/1979 | Piazza | ..... | 264/71 |
| 4,289,293 | A | 9/1981 | Cashion | | |
| 4,416,842 | A * | 11/1983 | Nash et al. | ..... | 264/145 |
| 4,457,682 | A | 7/1984 | Nash et al. | | |
| 5,398,470 | A * | 3/1995 | Ritter et al. | ..... | 52/309.11 |
| 6,298,622 | B1 * | 10/2001 | Cretti | ..... | 52/309.7 |
| 6,457,288 | B2 | 10/2002 | Zambelli et al. | ..... | 52/220.2 |
| 6,705,055 | B2 * | 3/2004 | Ritter et al. | ..... | 52/309.11 |
| 6,718,712 | B1 * | 4/2004 | Heath | ..... | 52/309.12 |

* cited by examiner

*Primary Examiner*—Carl D. Friedman
*Assistant Examiner*—Chi Q. Nguyen
(74) *Attorney, Agent, or Firm*—Vidas, Arrett & Steinkraus

(57) ABSTRACT

Improved premolded foam billets and drop-in foam billet joints increase the R value in concrete panels.

2 Claims, 6 Drawing Sheets

INSULATED CONCRETE PANEL BILLETS

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to concrete panel construction and in particular to insulating foam billets used in the manufacture of finished concrete panels.

The assignee of this invention owns U.S. patent application Ser. No. 10/391,081 filed Mar. 17, 2003 (F02.2-11001US01) which relates to a method for casting hollow core concrete panels in which the hollow cores are made by the use of foam billets held in place during the pours by using a raft connector, the disclosure of which is incorporated herein by reference. Extruders are eliminated via the invention herein. This represents the only hollow core concrete panel which may include cast in openings. That invention is an improvement over U.S. patent application Ser. No. 10/289,819 filed Nov. 7, 2002 (F02.2-10233US02) by the same owner, the disclosure of which is also incorporated herein by reference.

The pending applications of applicant referred to above work very well. However, it is desirable to form concrete panels which would have a higher insulating R value. This invention provides foam billets which provide for the manufacture of higher R value concrete panels.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The invention provides pre-molded foam billets that may be set in place to cover most of the panel such that the casting process of manufacturing concrete panels may result in an increased R value product while keeping manufacturing costs down and preventing flotation of the foam billets. The foam billets of the invention are designed with a plurality of spaced through holes and edge modifications are provided in the foam billets to ensure that an interlock between the lower and upper layers of concrete is made.

Alternatively, it has been found that the prior foam billets as described in the pending applications may be used along with a plurality of spaced drop-in foam billet joints which increases the R value and maintains the needed concrete bonding between layers.

BRIEF DESCRIPTION OF THE DRAWINGS

A detailed description of the invention is hereafter described with specific reference being made to the drawings in which.

DETAILED DESCRIPTION OF THE INVENTION

Figure 3:
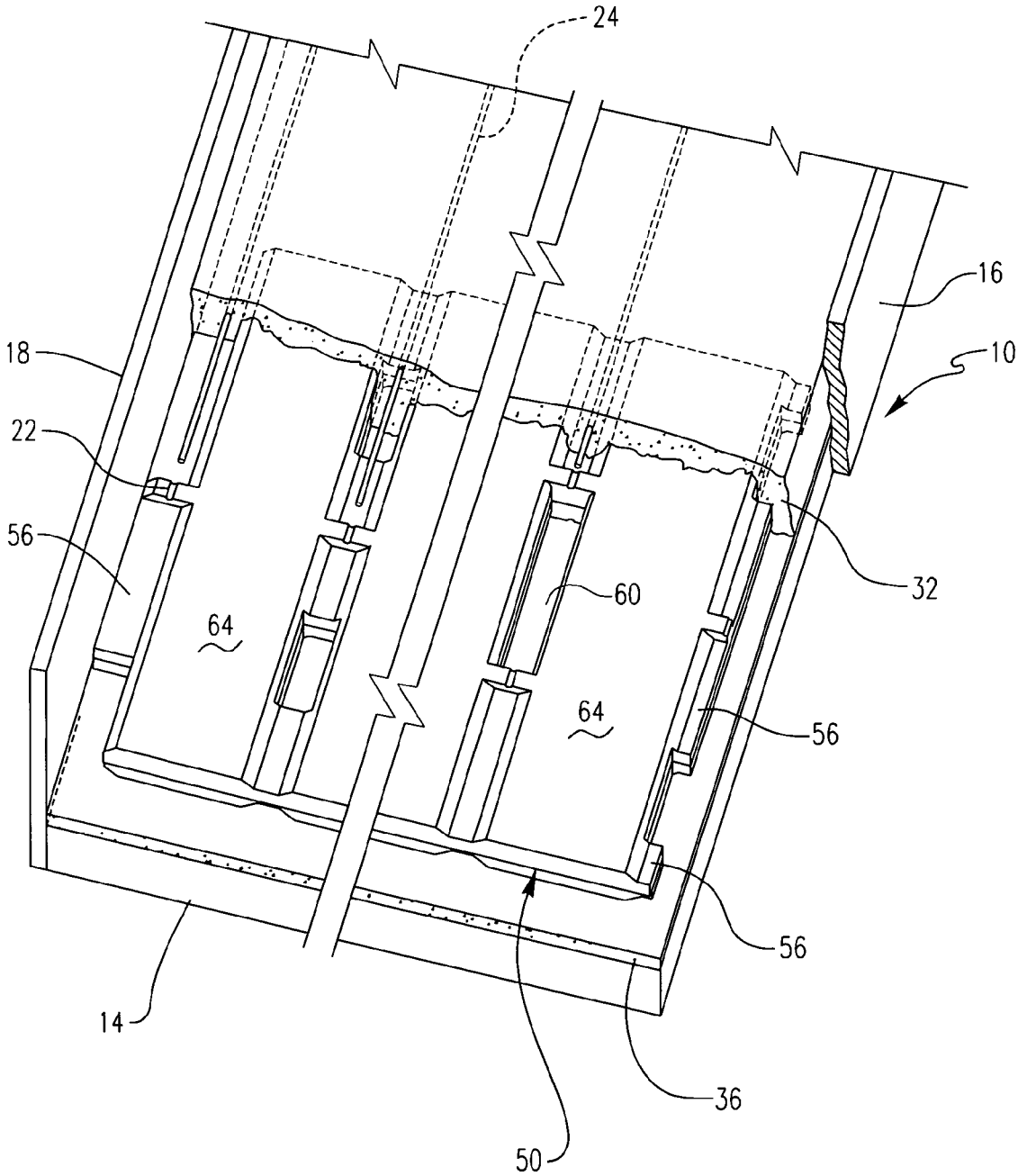
FIG. 3 is a perspective view showing the molded foam billet of the invention of FIG. 1 in a casting bed with concrete encasing the billet and portions left uncovered.

With reference to the Figures, the inventive foam billets to manufacture concrete slabs, panels or planks of the invention are formed with a standard concrete casting apparatus as shown in U.S. Pat. Nos. 3,217,375; 3,523,343; 4,004,874; 4,289,293 and 4,457,682, the disclosures of which are incorporated herein by reference. Basically, as shown in FIG. 3, such apparatus 10 include a casting bed 12 that is either stationary or is driven along rails. The casting bed 12 has a bottom pallet 14 and side walls 16, 18. A concrete dispensing hopper can be of any of the current hoppers used to distribute concrete onto a moving bed. Alternatively, the hopper may move relative to a stationary bed. Lower and upper prestressed cables, 22, 24, respectively, are positioned along the length of the bed 12.

Figure 5:
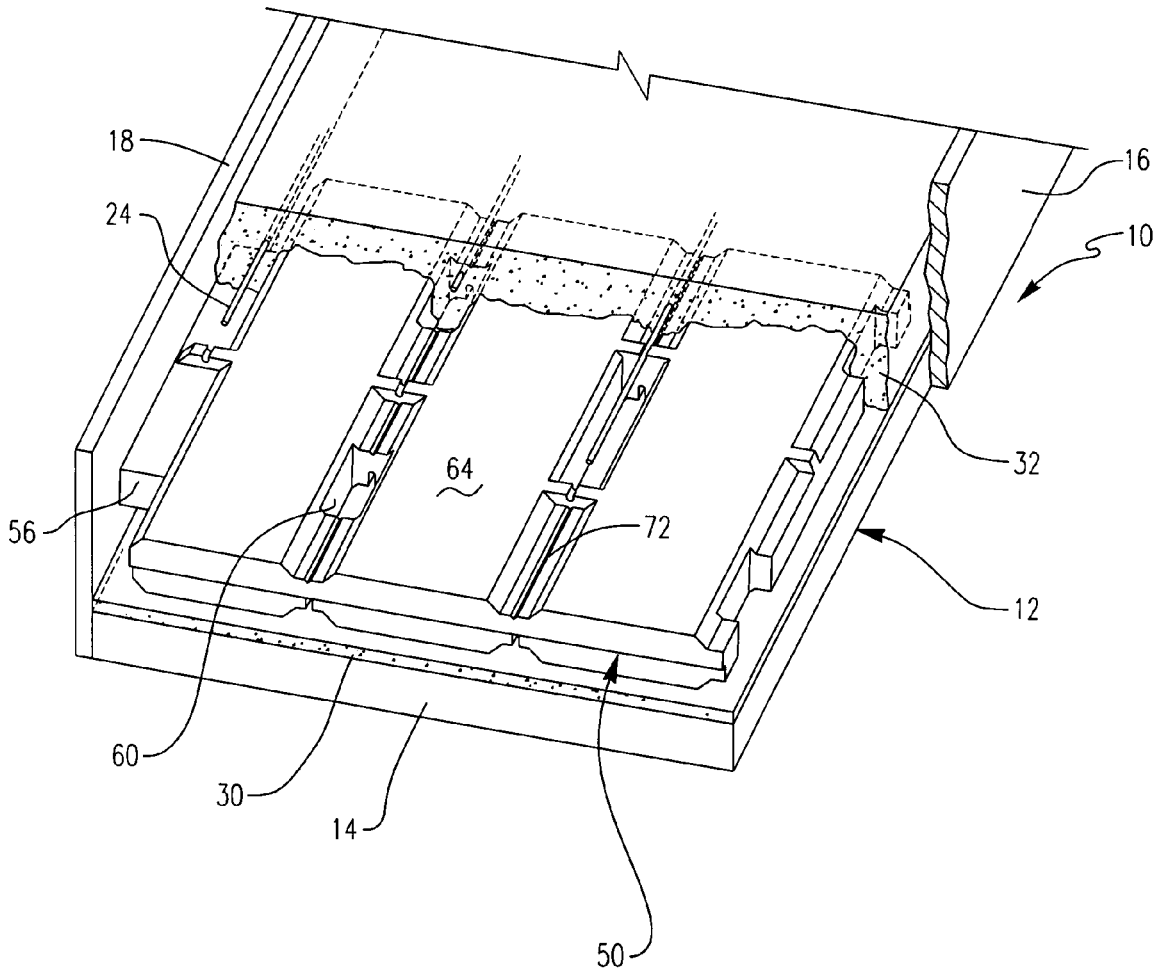
FIG. 5 is a view similar to that of FIG. 3 using the billets of FIG. 4.
Figure 6:
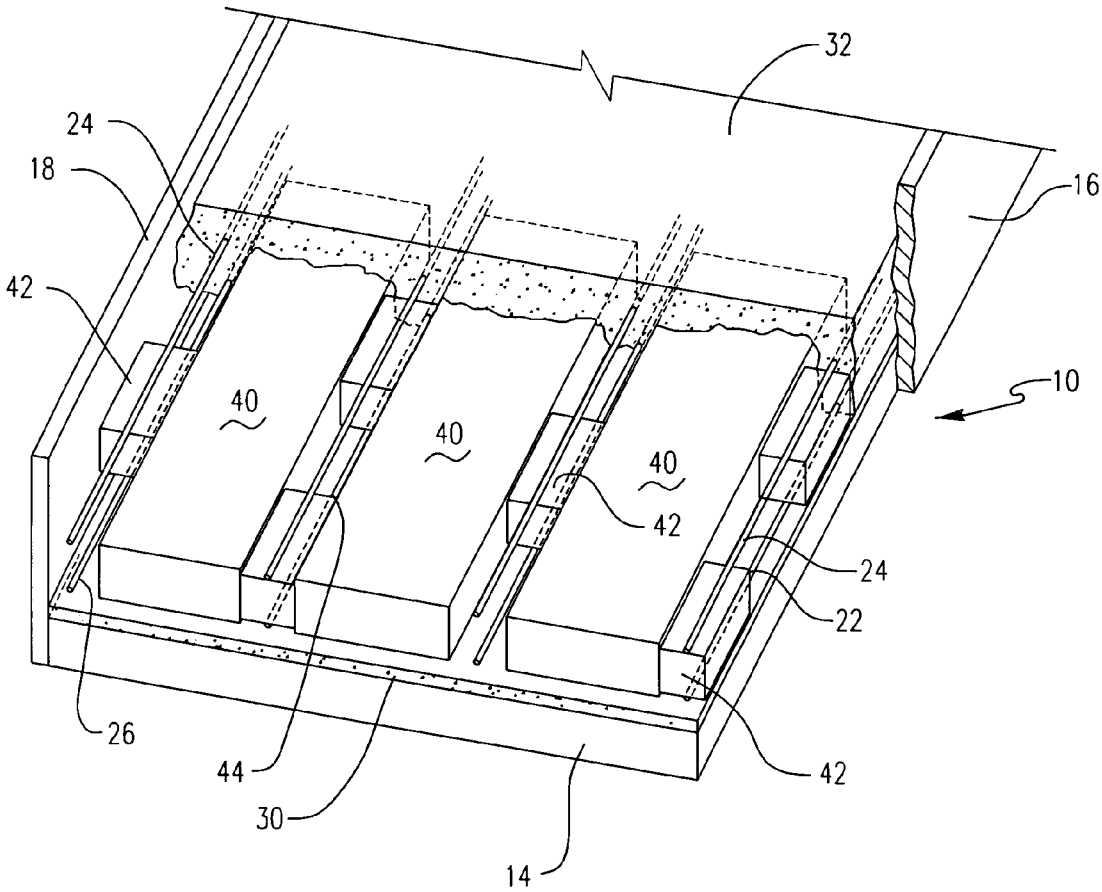
FIG. 6 is a perspective view of the standard foam billets used in connection with drop-in foam billet joints.

In operation, as, shown in FIGS. 3, 5 and 6, a first layer of concrete 30 is cast with a very fluid mix called "self-compacting concrete" in the industry. This concrete does not require a screed step. Conventional foam billets 40 which are generally rectangular in shape are shown in FIG. 6. This view is similar to that in applicant's previous applications with the exception of additional drop-in fill joint billet blocks 42 which are placed against the casting bed side walls 16, 18 as shown and between each billet 40.

The billet blocks 42 are spaced from one another to ensure that concrete from the lower layer 30 may bond to the upper concrete layer 32. In addition, the drop-ins 42 are desirably placed at every billet joint. Therefore, if each billet is 8 feet in length, a billet block 42 should be at least every 8 feet. In addition, it is preferred that the billet joints are staggered and that no more than three billet blocks 42 are lined up across the width of the panel. A typical billet block 42 may be about 16 inches in length for ease of handling and insertion. Space 44 is left between each succeeding billet block 42 for concrete bonding.

The billets 40 are held to the concrete by any mechanical connections such as wire tied rebar that may be placed over and across the width of the bed and tied to cable 24. It has been found that a substantial holding force is generated simply by the placement of foam onto the lower wet concrete. Finally, the top layer of concrete 32 is cast which is a traditional concrete mix. Any additional insulating sheets are placed on top of the structural section.

FIGS. 1 through 5 show that a premolded billet 50 may be used in the casting beds 12 which are formed with sides 52, 54 which have staggered projections 56 such that insulation is provided along the edges of the finished concrete panel yet gaps are provided to provide the required bonding of concrete layers. The internal body of the premolded billets 50 may have a plurality of staggered concrete bonding openings 60 as shown. The lower concrete 30 is able to bond to the upper layer of concrete 32 through openings 32. It may also be desirable to mold premolded billets 50 to include partial channels 62 which are spaced to fit around the prestressed cables 22, 24. Note that the premolded billets 50 of the FIGS. are shown with three main sections 64 separated by two channels 62. This is for simplicity. In a standard eight foot wide panel a total of six main sections 64 may be employed along with seven channels 62. This will vary depending on the width of the panel and the spacing and number of prestressing cables 22, 24.

Figure 1:
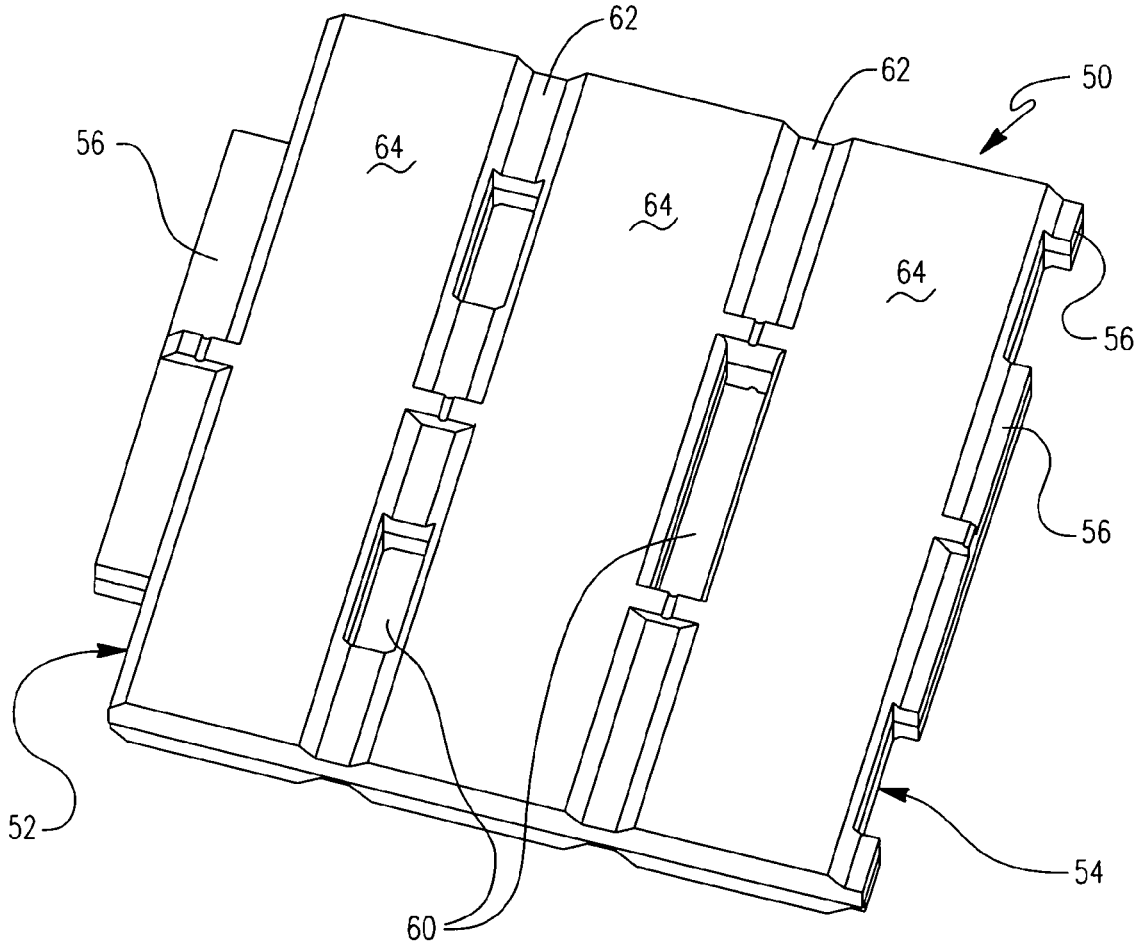
FIG. 1 is a perspective view of a molded foam billet of the invention.
Figure 2:
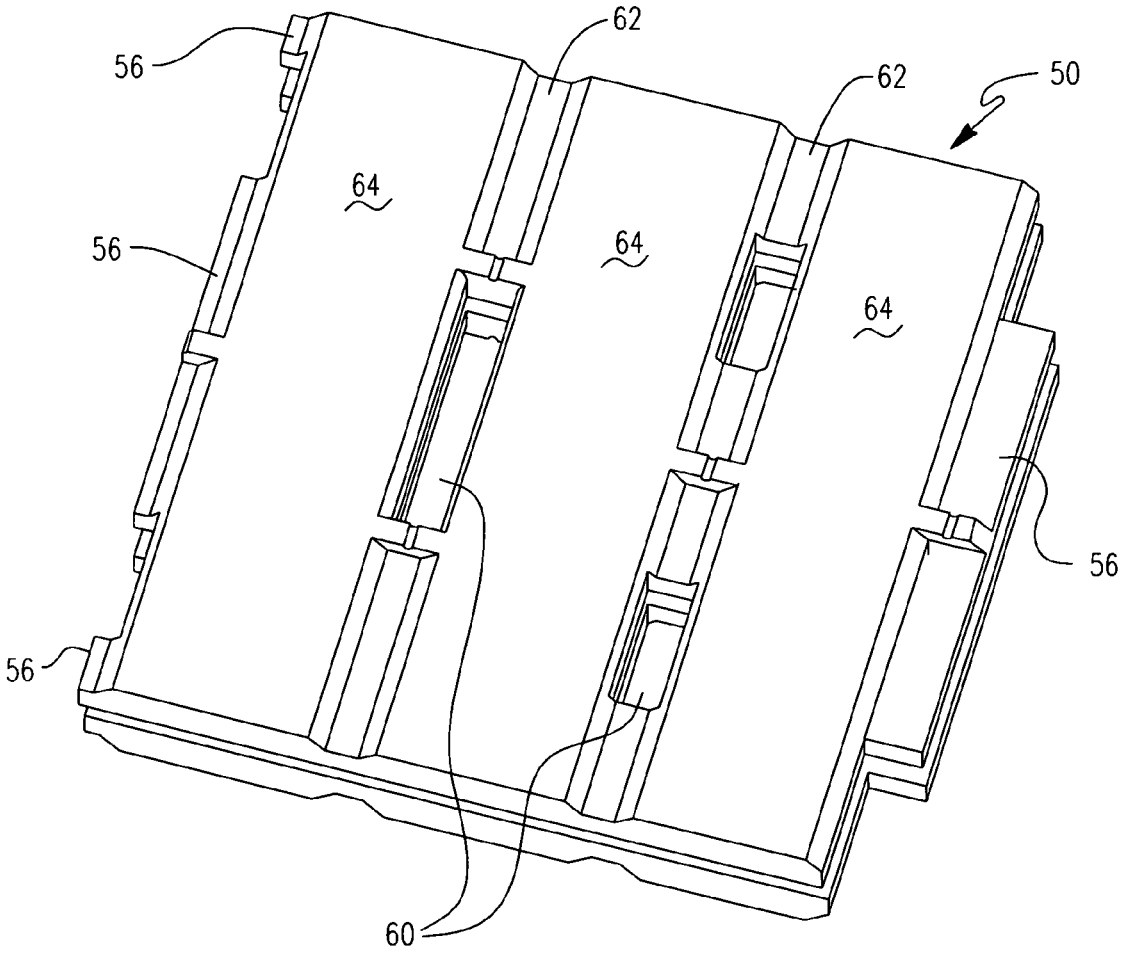
FIG. 2 is a mirror image of the molded foam billet of the invention of FIG. 1 to show the appearance of the bottom side.

Note that to keep the desired spacing of staggered edges and openings that a premolded billet 50 of FIG. 1 is followed by its mirror image, a flipped over premolded billet 50 of FIG. 2, and vice versa. This ensures that maximum coverage of the finished concrete panel with insulating billet material will occur while keeping the required bonding between the lower and upper concrete layers.

Figure 4:
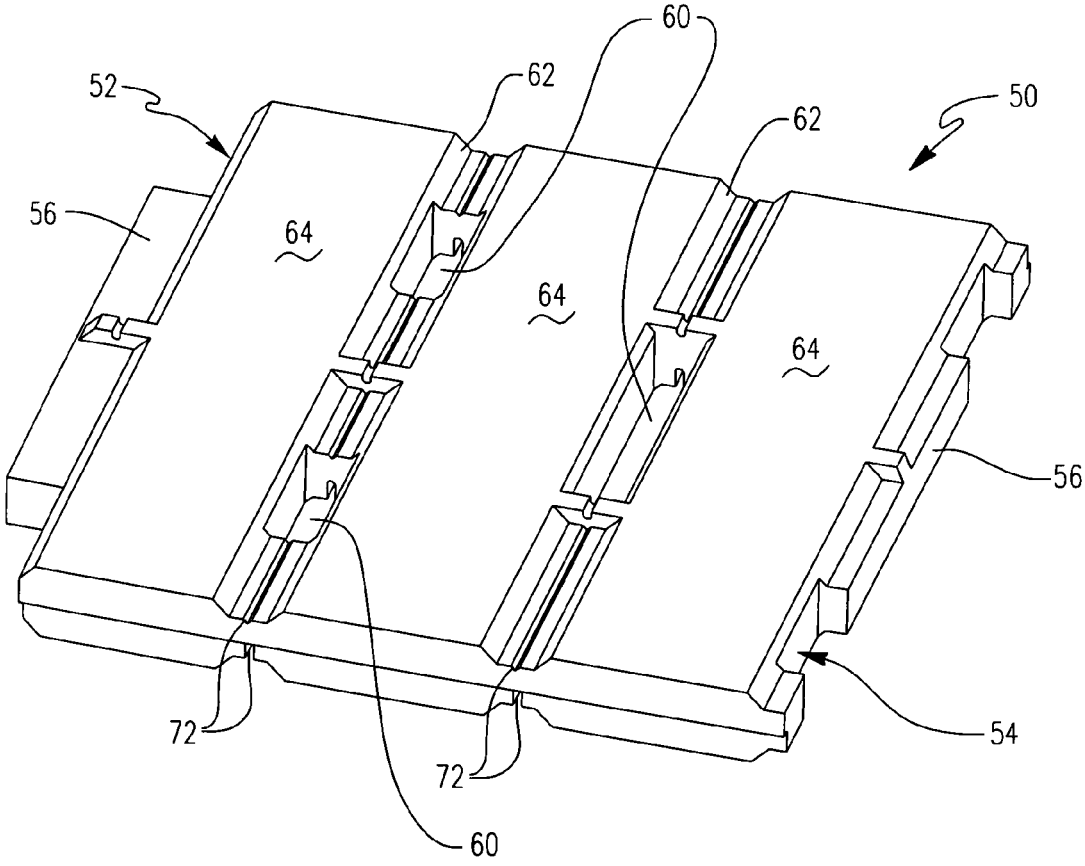
FIG. 4 is a foam billet variant to FIG. 1.

FIGS. 4 and 5 show a premolded billet 50 having main sections 64 and channels 62. However, it also depicts that cable channels 70 may be formed within channels 62 to better locate the premolded billets 50 to the casting bed by forming guides to the prestressed cables 22, 24.

When used herein, the term "foam billets" refers to billets of any material that become an integral member of the finished panel. Where billets is used herein, it refers to foam billets but also to any shape holding structure that may be placed in the bed to form a void for the hollow core panels to be formed.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A cast concrete panel comprising:

a) a lower layer of concrete;

b) a plurality of spaced longitudinal prestressing cables through the length of said concrete panel;

c) foam billets above said lower layer of concrete positioned between said prestressing cables;

d) a plurality of staggered, spaced foam billet blocks positioned between said billets; and e) an upper layer of concrete surrounding said billets and billet blocks and being bonded to said lower layer of concrete.

2. The cast concrete panel of claim 1 wherein said staggered, spaced foam billet blocks are further positioned adjacent longitudinal edges of said concrete panels.

* * * * *